US008317528B2

(12) United States Patent
Chen et al.

(10) Patent No.: US 8,317,528 B2
(45) Date of Patent: Nov. 27, 2012

(54) INTELLIGENT ELECTRICAL CONNECTOR

(75) Inventors: Wei-Yao Chen, Taoyuan Hsien (TW); Jui-Yuan Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/183,074

(22) Filed: Jul. 14, 2011

(65) Prior Publication Data

US 2012/0021629 A1 Jan. 26, 2012

(30) Foreign Application Priority Data

Jul. 22, 2010 (TW) ..... 99124221 A

(51) Int. Cl.
*H01R 29/00* (2006.01)

(52) U.S. Cl. ..... 439/188; 439/607.34

(58) Field of Classification Search ..... 439/188, 439/607.34

See application file for complete search history.

(56) References Cited

U.S. PATENT DOCUMENTS 5,674,085 A * 10/1997 Davis et al. ..... 439/188
7,137,836 B2 * 11/2006 Lu et al. ..... 439/188
7,416,428 B1 * 8/2008 Hung et al. ..... 439/188
7,575,454 B1 * 8/2009 Aoki et al. ..... 439/188
7,607,926 B2 * 10/2009 Wang ..... 439/188
7,641,518 B2 * 1/2010 Lee et al. ..... 439/660
7,798,832 B2 * 9/2010 Qin et al. ..... 439/188
2007/0059959 A1 * 3/2007 Chen ..... 439/188
2011/0143593 A1 * 6/2011 Liu et al. ..... 439/607.34

* cited by examiner

*Primary Examiner* — Briggitte R Hammond
(74) *Attorney, Agent, or Firm* — Kirton McConkie; Evan R. Witt

(57) ABSTRACT

An intelligent electrical includes a metallic shielding case, an insulating main body, plural conducting terminals and at least one detecting element. The metallic shielding case includes a receiving space and at least one elastic sustaining element. The insulating main body includes a first body part and a second body part. The first body part is accommodated within the receiving space. The second body part is exposed outside the metallic shielding case. The detecting element is disposed on the second body part, arranged beside the elastic sustaining element of the metallic shielding case, and selectively contacted with or separated from the elastic sustaining element. When the elastic sustaining element is contacted with the detecting element, the electricity is permitted to be transmitted through the intelligent electrical connector. Whereas, when the elastic sustaining element is separated from the detecting element, the electricity fails to be transmitted through the intelligent electrical connector.

11 Claims, 6 Drawing Sheets

INTELLIGENT ELECTRICAL CONNECTOR

FIELD OF THE INVENTION

The present invention relates to an electrical connector, and more particularly to an intelligent electrical connector.

BACKGROUND OF THE INVENTION

As known, universal serial bus connectors (hereinafter referred as USB connectors) are electrical connectors widely used in diversified electronic devices such as personal computers, notebook computers, personal digital assistants (PDAs), multimedia players, portable hard disc drives, power supply apparatuses, or the like. USB (Universal Serial Bus) is a specification to establish communication between a USB host device and a USB peripheral device. Generally, the USB connectors may be classified into two types, i.e. USB sockets and USB plugs. The host device that provides electricity has a USB socket, and the USB peripheral device has a USB plug. In other words, the USB socket may be used as a power socket. Through the USB socket, the host device may provide electricity to the external peripheral device or charge a chargeable battery within the external peripheral device.

For example, an external peripheral device such as a mobile phone, a notebook computer or a personal digital assistant may be powered by common chargers. In addition, the external peripheral device may be electrically connected with a host device (e.g. a personal computer, a power supply or a power adapter) having a USB socket through a USB cable in order to receive electricity from the host device.

The use of the conventional USB socket, however, still has some drawbacks. For example, even if no mating electric connector (i.e. a USB plug) is inserted into the USB socket or the electronic device with the USB socket is in a no-load condition, electricity is still transmitted to the USB socket. Under this circumstance, the power consumption is increased, the operating efficiency is decreased, and the USB socket fails to meet the power-saving requirement. For solving these drawbacks, an additional mechanical switch is used for switching the on/off statuses of the USB socket. As known, the mechanical switch has complicated configurations and increased fabricating cost. In addition, the use of the mechanical switch is detrimental to space utilization and miniaturization of the electrical connector. Since the transmission of the electrical power through the USB socket is controlled by manually adjusting the mechanical switch, this controlling approach is not user-friendly.

SUMMARY OF THE INVENTION

The present invention provides an intelligent electrical connector, in which electricity is permitted or restricted to be transmitted through the intelligent electrical connector depending on the connection status or disconnection status between the intelligent electrical connector and a mating electrical connector. In such way, the power consumption is reduced and the operating efficiency is enhanced to meet the power-saving requirement.

The present invention further provides an intelligent electrical connector having simple configurations, reduced fabricating cost and enhanced space utilization.

The present invention further provides an intelligent electrical connector having a function of detecting whether a mating electrical connector is connected therewith.

In accordance with an aspect of the present invention, the intelligent electrical connector includes a metallic shielding case, an insulating main body, plural conducting terminals and at least one detecting element. The metallic shielding case includes a receiving space and at least one elastic sustaining element. The insulating main body includes a first body part and a second body part. The first body part is accommodated within the receiving space of the metallic shielding case. The second body part is exposed outside the metallic shielding case. The conducting terminals are partially accommodated within the receiving space. The detecting element is disposed on the second body part, arranged beside the elastic sustaining element of the metallic shielding case, and selectively contacted with or separated from the elastic sustaining element. When the elastic sustaining element is contacted with the detecting element, electricity is permitted to be transmitted through the intelligent electrical connector. Whereas, when the elastic sustaining element is separated from the detecting element, electricity fails to be transmitted through the intelligent electrical connector.

In accordance with another aspect of the present invention, the intelligent electrical connector includes a metallic shielding case, an insulating main body, plural conducting terminals and at least one detecting element. The metallic shielding case includes a receiving space and at least one elastic sustaining element. The insulating main body is at least partially accommodated within the receiving space of the metallic shielding case. The conducting terminals are partially accommodated within the receiving space. The detecting element is arranged beside the elastic sustaining element of the metallic shielding case. When an additional mating electronic connector is inserted into the receiving space, the detecting element is contacted with the elastic sustaining element and electricity is permitted to be transmitted through the intelligent electrical connector. Whereas, when no additional mating electronic connector is inserted into the receiving space, the detecting element is separated from the elastic sustaining element and electricity fails to be transmitted through the intelligent electrical connector.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
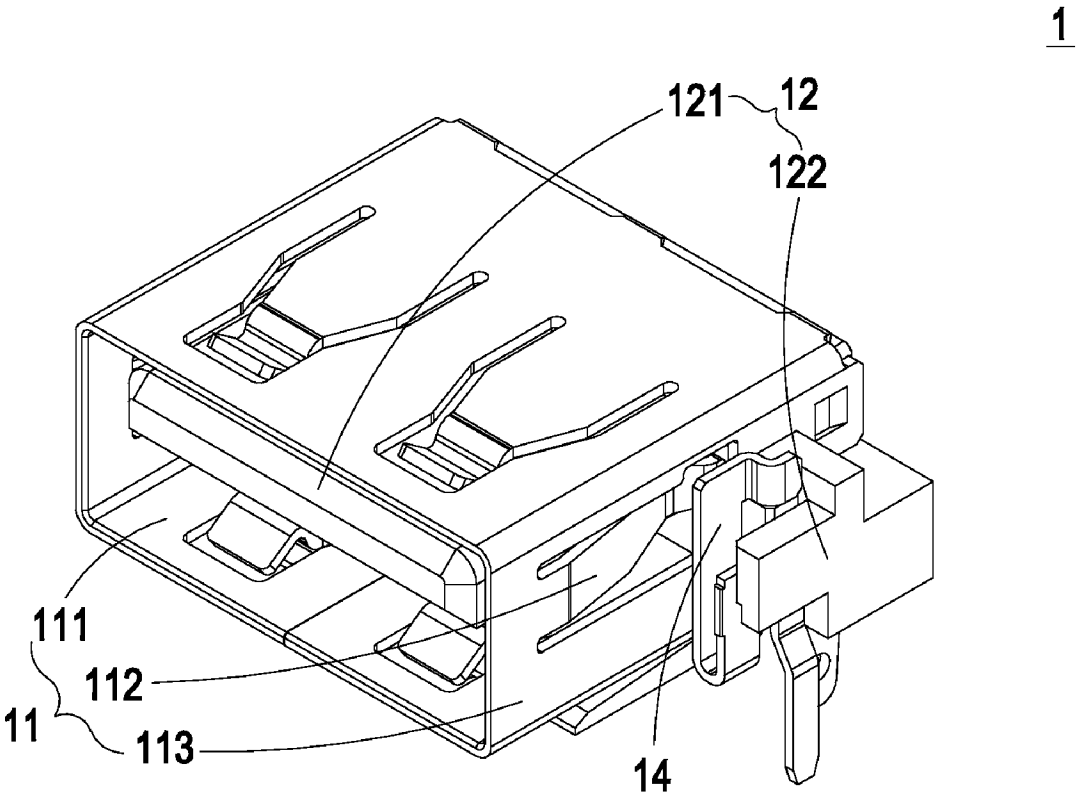
FIGS. 1A, 1B and 1C are schematic perspective views illustrating an intelligent electrical connector according to an embodiment of the present invention and respectively taken along different viewpoints.
Figure 1B:
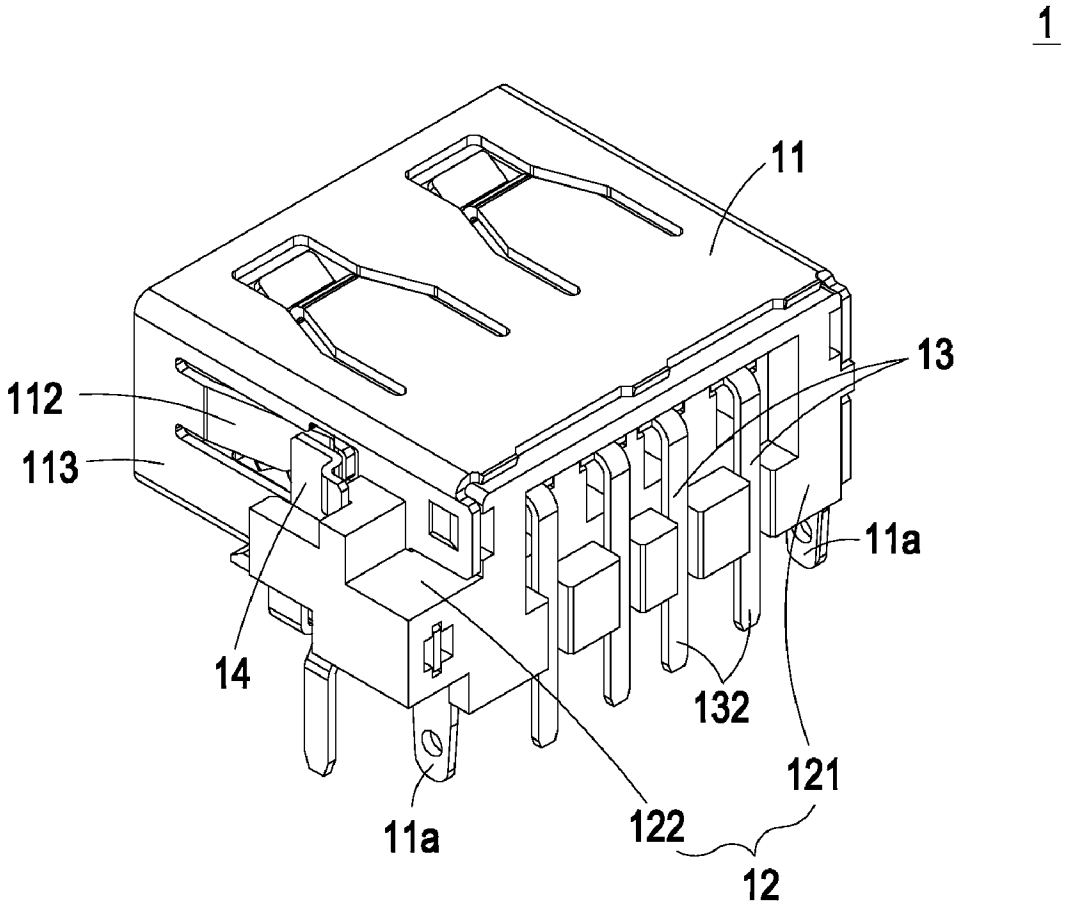
Figure 1C:
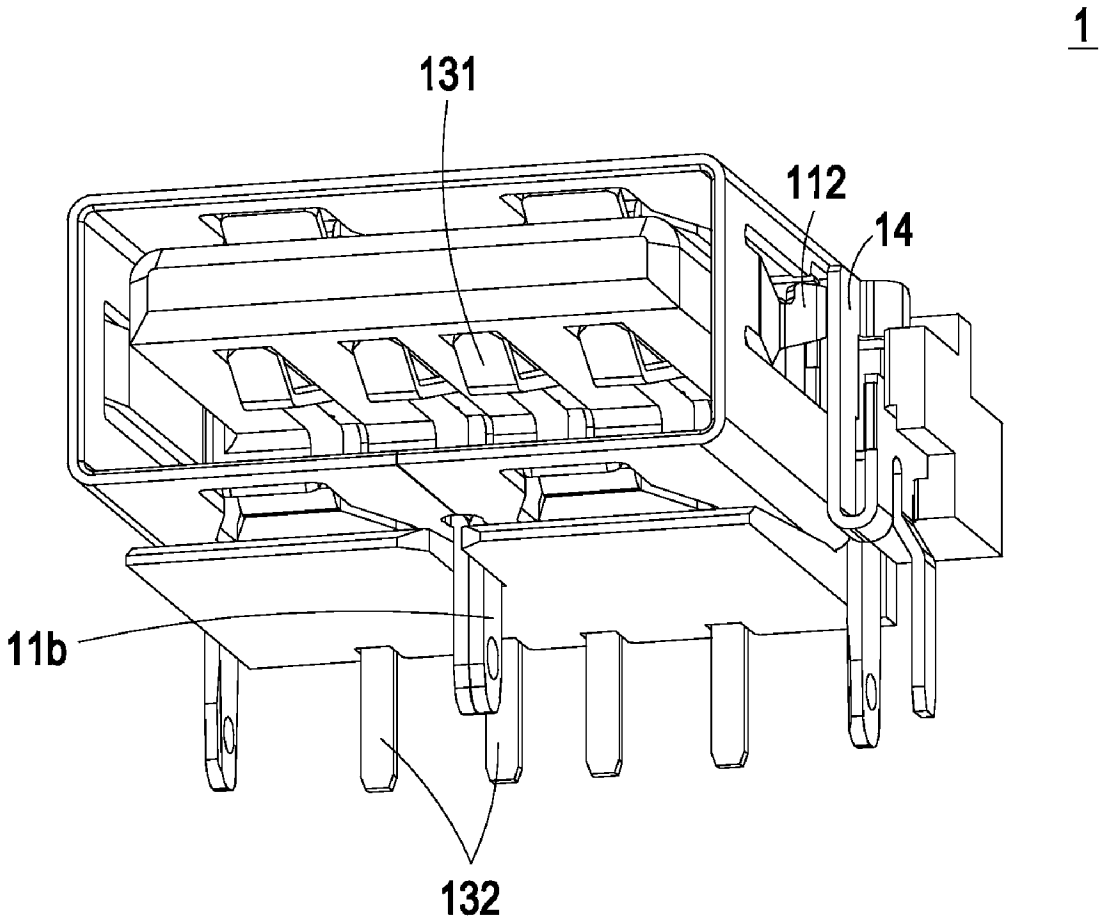

FIGS. 1A, 1B and 1C are schematic perspective views illustrating an intelligent electrical connector according to an embodiment of the present invention and respectively taken along different viewpoints. An example of the intelligent electrical connector 1 includes but is not limited to a USB connector. It is preferred that the intelligent electrical connector 1 is a USB socket. As shown in FIGS. 1A, 1B and 1C, the intelligent electrical connector 1 includes a metallic shielding case 11, an insulating main body 12, plural conducting terminals 13 and at least one detecting element 14.

The metallic shielding case 11 includes a receiving space 111 and at least one elastic sustaining element 112. The insulating main body 12 includes a first body part 121 and a second body part 122. The first body part 121 and the second body part 122 are connected with each other. It is preferred that the first body part 121 and the second body part 122 are integrally formed. The first body part 121 is accommodated within the receiving space 111 of the metallic shielding case 11. The second body part 122 is exposed outside the metallic shielding case 11. For example, the second body part 122 is protruded outside a first sidewall 113 of the metallic shielding case 11.

The plural conducting terminals 13 have respective contacting parts 131 and respective pin parts 132. The contacting parts 131 of the conducting terminals 13 are disposed on the first body part 121. The contacting parts 131 and the first body part 121 are accommodated within the receiving space 111 of the metallic shielding case 11. The pin parts 132 of the conducting terminals 13 are protruded outside the first body part 121 and the metallic shielding case 11. In addition, the pin parts 132 are substantially perpendicular to the contacting parts 131.

The detecting element 14 is disposed on the second body part 122 of the insulating main body 12 and arranged beside the elastic sustaining element 112 of the metallic shielding case 11. The detecting element 14 is either contacted with or separated from the elastic sustaining element 112. The connection status or the disconnection status between the elastic sustaining element 112 and the detecting element 14 may be utilized to determine whether electricity is transmitted through the intelligent electrical connector 1. For example, in a case that a mating electronic connector (not shown) is inserted into the receiving space 111 of the intelligent electrical connector 1, the mating electronic connector is sustained against the elastic sustaining element 112, so that the elastic sustaining element 112 is moved toward the detecting element 14 to be contacted with the detecting element 14. When the elastic sustaining element 112 is contacted with the detecting element 14, a detecting signal issued from the intelligent electrical connector 1 to a circuit board 2 (see FIG. 4) is in an enabling status. In response to the enabling status of the detecting signal, the electricity may be transmitted through the intelligent electrical connector 1. Whereas, in a case that no mating electronic connector is inserted into the receiving space 111 of the intelligent electrical connector 1, the elastic sustaining element 112 is restored to its original position and separated from the detecting element 14. When the elastic sustaining element 112 is separated from the detecting element 14, a detecting signal issued from the intelligent electrical connector 1 to a circuit board 2 (see FIG. 4) is in a disabling status. In response to the disabling status of the detecting signal, the electricity fails to be transmitted through the intelligent electrical connector 1.

Figure 2:
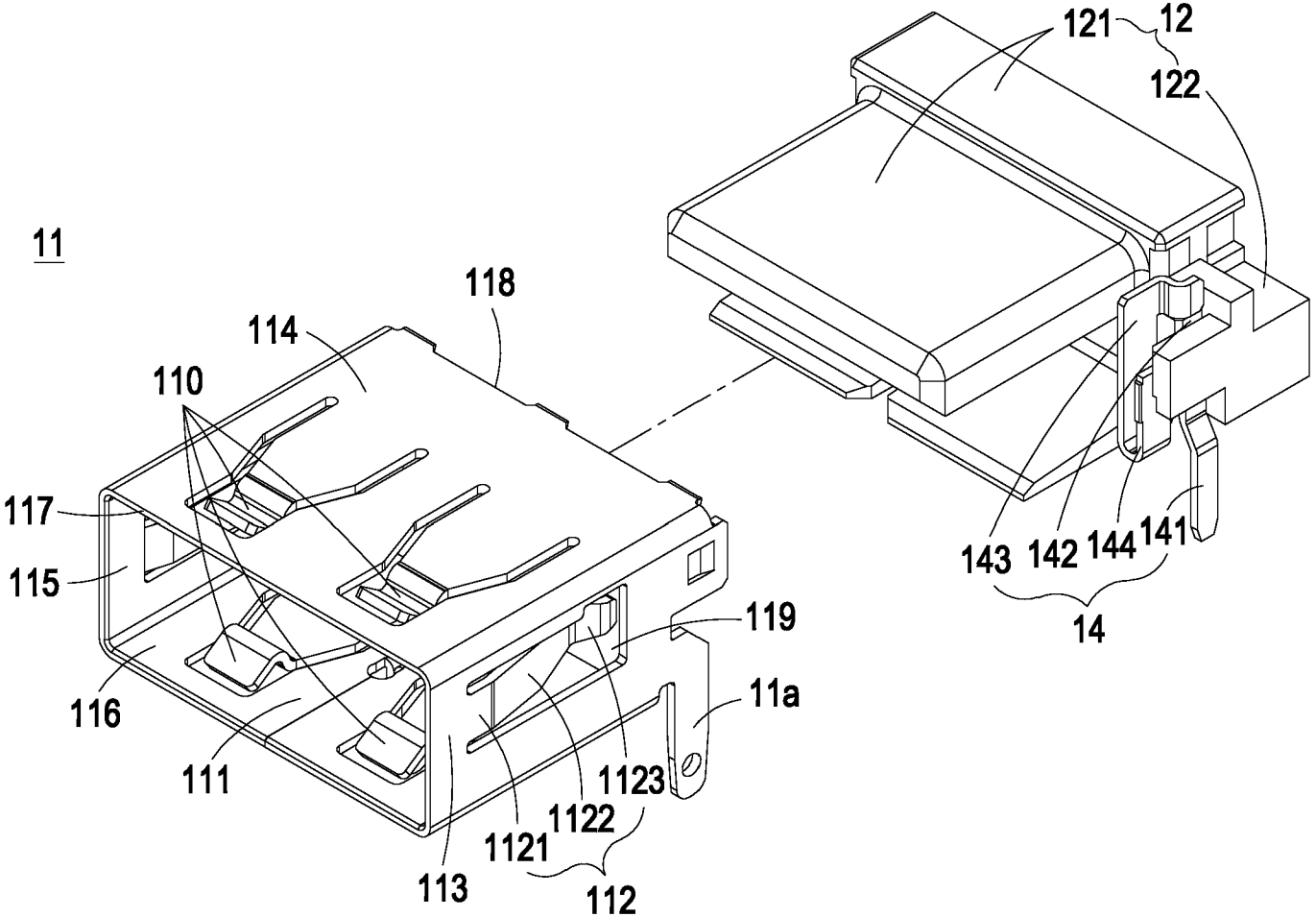
FIG. 2 is an exploded view illustrating the intelligent electrical connector as shown in FIG. 1.

FIG. 2 is an exploded view illustrating the intelligent electrical connector as shown in FIG. 1. Please refer to FIGS. 1A, 1B, 1C and 2. The metallic shielding case 11 has a first sidewall 113, a second sidewall 114, a third sidewall 115, a fourth sidewall 116, a first opening 117 and a second opening 118. The first sidewall 113 is connected with the second sidewall 114 and the fourth sidewall 116. The third sidewall 115 is opposed to the first sidewall 113. The first opening 117 and the second opening 118 are opposed to each other. The mating electrical connector (not shown) can be inserted into the receiving space 111 of the intelligent electrical connector 1 through the first opening 117. The plural conducting terminals 13 are protruded outside the first body part 121 and the metallic shielding case 11 through the second opening 118. Moreover, the first sidewall 113 has a slot 119. The elastic sustaining element 112 is aligned with the slot 119 and partially accommodated within the receiving space 111. The elastic sustaining element 112 has a connecting segment 1121, a bending segment 1122 and a contacting segment 1123. The connecting segment 1121 is connected with a periphery of the slot 119. The bending segment 1122 is arranged between the connecting segment 1121 and the contacting segment 1123, and internally concaved to the receiving space 111. The contacting segment 1123 is connected with the contacting segment 1123 and formed as a free end. The contacting segment 1123 is either contacted with or separated from the detecting element 14.

The metallic shielding case 11 further includes plural elastic fastening elements 110. For example, the elastic fastening elements 110 are respectively arranged on the second sidewall 114 and the fourth sidewall 116. When a mating electrical connector such as a USB plug (not shown) is inserted into the receiving space 111 of the intelligent electrical connector 1, the elastic fastening elements 110 are engaged with corresponding elastic fastening elements of the mating electrical connector so that the intelligent electrical connector 1 and the mating electrical connector are combined with each other. In this embodiment, the metallic shielding case 11 comprises two elastic sustaining elements 112, which are respectively arranged at the first sidewall 113 and the third sidewall 115. After the mating electrical connector is inserted into the receiving space 111 of the intelligent electrical connector 1, the two elastic sustaining elements 112 are sustained against corresponding sidewalls of the mating electrical connector for facilitating fixing the mating electrical connector.

In some embodiments, the metallic shielding case 11 further includes plural fixing pins 11*a* and at least one ground pin 11*b*. The fixing pins 11*a* may be inserted into corresponding fixing holes (not shown) of the circuit board, so that the intelligent electrical connector 1 is firmly fixed on the circuit board. The ground pin 11*b* is connected to a ground pin (not shown) of the circuit board. In other words, the ground pin 11*b* is used as the ground terminal of the metallic shielding case 11. After the mating electrical connector is inserted into the receiving space 111 of the intelligent electrical connector 1, the ground pin 11*b* provides a static electricity discharging path.

Please refer to FIG. 2 again. The detecting element 14 is embedded in the second body part 122. The detecting element 14 has a pin part 141, a coupling part 142, a contacting part 143 and an elastic part 144. The pin part 141 and the coupling part 142 are connected with each other. The coupling part 142 and the contacting part 143 are connected with each other. The contacting part 143 and the elastic part 144 are connected with each other. In this embodiment, the pin part 141 is extended downwardly and may be inserted into a corresponding conductive hole (not shown) of the circuit board. As such, the detecting element 14 is electrically connected with a detecting circuit or a control circuit of the circuit board. The coupling part 142 is partially embedded in the second body part 122, so that the detecting element 14 is fixed on the second body part 122. The contacting part 143 is arranged beside the contacting segment 1123 of the elastic sustaining element 112, so that the contacting part 143 is either contacted with or separated from the contacting segment 1123 of the elastic sustaining element 112. The elastic part 144 is sustained against the second body part 122. The restoring force resulted from the elastic part 144 may facilitate the contacting part 143 to be elastically contacted with the elastic sustaining element 112.

Figure 3:
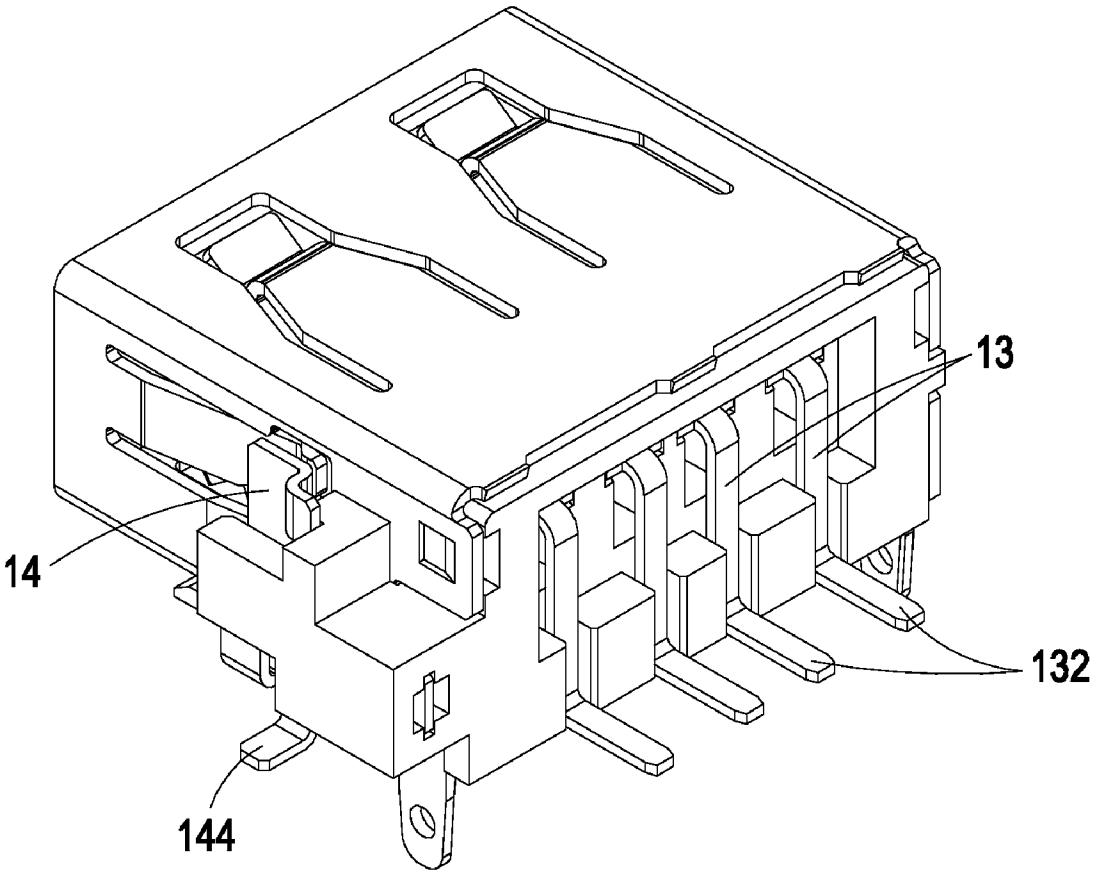
FIG. 3 is a schematic perspective view illustrating an intelligent electrical connector according to another embodiment of the present invention.

FIG. 3 is a schematic perspective view illustrating an intelligent electrical connector according to another embodiment of the present invention. In this embodiment, the pin parts 132 of the conducting terminals 13 and the pin parts 144 of the detecting element are surface mount pins. As such, the intelligent electrical connector 1 may be installed on the circuit board according to a surface mount technology. The intelligent electrical connector 1 may be installed on a circuit board of a power adapter, a power supply or a charger.

Figure 4B:
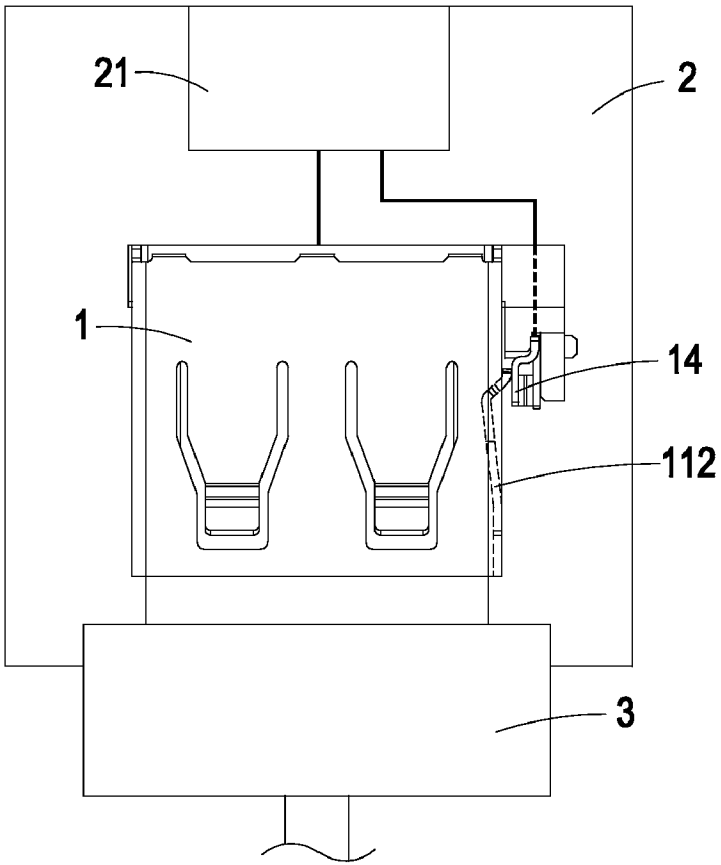
FIG. 4B is a schematic view illustrating the relation between the intelligent electrical connector and the circuit board, in which a mating electronic connector is inserted into the intelligent electrical connector.
Figure 4A:
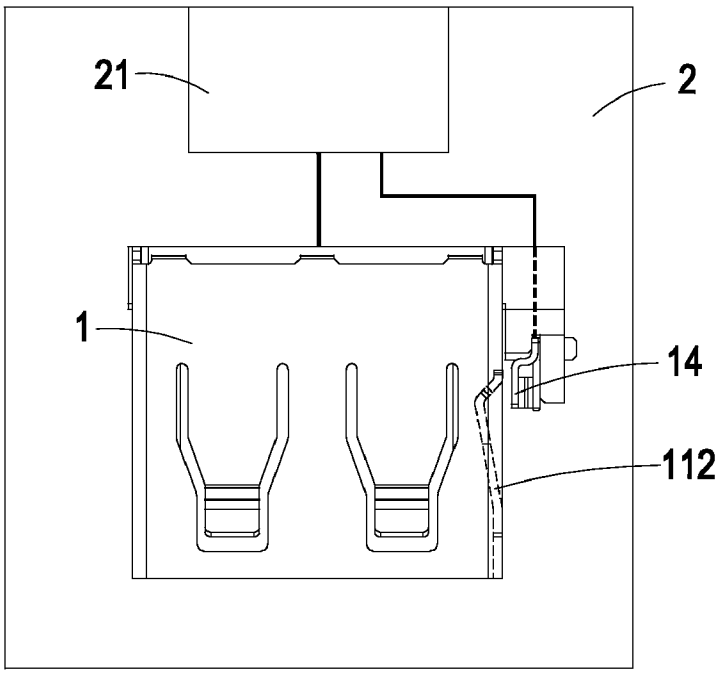
FIG. 4A is a schematic view illustrating the relation between the intelligent electrical connector and the circuit board, in which no mating electronic connector is inserted into the intelligent electrical connector.

FIG. 4A is a schematic view illustrating the relation between the intelligent electrical connector and the circuit board, in which no mating electronic connector is inserted into the intelligent electrical connector. Since no mating electronic connector is inserted into the receiving space 111 of the intelligent electrical connector 1, the elastic sustaining element 112 and the detecting element 14 are separated from each other. In this situation, a detecting signal in a disabling status is issued from the intelligent electrical connector 1 to a specified circuit 21 of the circuit board 2. The specified circuit 21 is for example a detecting circuit, a controlling circuit or a power conversion circuit. In response to the disabling status of the detecting signal, the electricity fails to be transmitted through the intelligent electrical connector 1.

FIG. 4B is a schematic view illustrating the relation between the intelligent electrical connector and the circuit board, in which a mating electronic connector is inserted into the intelligent electrical connector. Please refer to FIGS. 1A, 1B, 1C and 4. After a mating electronic connector 3 (e.g. a USB plug) is inserted into the receiving space 111 of the intelligent electrical connector 1, the sidewalls of the mating electronic connector 3 will be sustained against the elastic sustaining element 112, so that the elastic sustaining element 112 and the detecting element 14 are contacted with each other. In addition, the metallic shielding case 11 of the intelligent electrical connector 1 is connected with a ground terminal of the circuit board 2, and the detecting element 14 is connected with the specified circuit 21 of the circuit board 21. Since the elastic sustaining element 112 and the detecting element 14 are contacted with each other, electrical connection between the detecting element 14 and the metallic shielding case 11 is rendered. In this situation, a detecting signal in an enabling status is issued from the intelligent electrical connector 1 to a specified circuit 21 of the circuit board 2. In response to the enabling status of the detecting signal, the electricity is permitted to be transmitted through the conducting terminals 13 of the intelligent electrical connector 1.

From the above description, the electricity fails to be transmitted through the intelligent electrical connector if no mating electric connector is inserted into the receiving space of the intelligent electrical connector or the electronic device with the intelligent electrical connector is in a no-load condition. On the other hand, the electricity is permitted to be transmitted through the intelligent electrical connector if a mating electric connector is inserted into the receiving space of the intelligent electrical connector or the electronic device with the intelligent electrical connector is in a normal-load condition. In such way, the power consumption is reduced and the operating efficiency is enhanced to meet the power-saving requirement. Moreover, the intelligent electrical connector of the present invention has simple configurations, reduced fabricating cost and enhanced space utilization. The intelligent electrical connector has a function of detecting whether a mating electrical connector is connected therewith. According to the connection status or disconnection status, the electricity is permitted or restricted to be transmitted through the intelligent electrical connector.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An intelligent electrical connector of an electronic device, comprising:

a metallic shielding case comprising a receiving space, at least one elastic sustaining element and a first sidewall having a slot, wherein said elastic sustaining element is aligned with said slot and internally concaved to said receiving space;

an insulating main body comprising a first body part and a second body part, wherein said first body part is accommodated within said receiving space of said metallic shielding case, and said second body part is exposed outside said metallic shielding case and protruded outside said first sidewall;

plural conducting terminals partially accommodated within said receiving space; and at least one detecting element disposed on said second body part, arranged beside said elastic sustaining element of said metallic shielding case, and selectively contacted with or separated from said elastic sustaining element, wherein when said elastic sustaining element is contacted with said detecting element, electricity is permitted to be transmitted through said intelligent electrical connector, wherein when said elastic sustaining element is separated from said detecting element, electricity fails to be transmitted through said intelligent electrical connector.

2. The intelligent electrical connector according to claim 1, wherein said intelligent electrical connector is a USB socket.

3. The intelligent electrical connector according to claim 1, wherein said first body part and said second body part are integrally formed.

4. The intelligent electrical connector according to claim 1, wherein said elastic sustaining element comprises a connecting segment, a bending segment and a contacting segment, wherein said connecting segment is connected with a periphery of said slot, said bending segment is arranged between said connecting segment and said contacting segment and internally concaved to said receiving space, and said contacting segment is connected with said bending segment and selectively contacted with or separated from said detecting element.

5. The intelligent electrical connector according to claim 1, wherein said metallic shielding case further comprises plural elastic fastening elements, plural fixing pins and at least one ground pin, wherein said ground pin is connected with a ground terminal of a circuit board of said electronic device.

6. The intelligent electrical connector according to claim 1, wherein said conducting terminals have respective contacting parts and respective pin parts, wherein said contacting parts are disposed on said first body part and accommodated within said receiving space of said metallic shielding case, and said pin parts are protruded outside said first body part.

7. The intelligent electrical connector according to claim 1, wherein said detecting element comprises:

a pin part;

a coupling part connected with said pin part, wherein said coupling part is at least partially embedded in said second body part so that said detecting element is fixed on said second body part;

a contacting part connected with said coupling part, and either contacted with or separated from the contacting segment of said elastic sustaining element; and an elastic part connected with said contacting part.

8. The intelligent electrical connector according to claim 1, wherein said conducting terminals and said detecting element are downward pins or surface mount pins.

9. The intelligent electrical connector according to claim 1, wherein when said elastic sustaining element is separated from said detecting element, a detecting signal in a disabling status is issued from said intelligent electrical connector to a circuit board of said electronic device, wherein in response to said disabling status of said detecting signal, electricity fails to be transmitted through the intelligent electrical connector.

10. The intelligent electrical connector according to claim 9, wherein when an mating electrical connector is inserted into said receiving part of said intelligent electrical connector, said elastic sustaining element is contacted with said detecting element so that a detecting signal in an enabling status is issued from said intelligent electrical connector to said circuit board, wherein in response to said enabling status of said detecting signal, electricity is permitted to be transmitted through said intelligent electrical connector.

11. An intelligent electrical connector, comprising:

a metallic shielding case comprising a receiving space, at least one elastic sustaining element and a first sidewall having a slot;

an insulating main body at least partially accommodated within said receiving space of said metallic shielding case and at least partially protruded outside said first sidewall, wherein said elastic sustaining element is aligned with said slot and internally concaved to said receiving space;

plural conducting terminals partially accommodated within said receiving space; and at least one detecting element arranged beside said elastic sustaining element of said metallic shielding case, wherein when an additional mating electronic connector is inserted into said receiving space, said detecting element is contacted with said elastic sustaining element and electricity is permitted to be transmitted through said intelligent electrical connector, wherein when no additional mating electronic connector is inserted into said receiving space, said detecting element is separated from said elastic sustaining element and electricity fails to be transmitted through said intelligent electrical connector.

* * * * *